United States Patent [19]

Salzer

[11] 4,099,156

[45] Jul. 4, 1978

[54] ELECTRIC FUSE CAPABLE OF INTERRUPTING SMALL CURRENTS

[75] Inventor: Erwin Salzer, Waban, Mass.

[73] Assignee: Gould Inc., Newburyport, Mass.

[21] Appl. No.: 780,353

[22] Filed: Mar. 23, 1977

[51] Int. Cl.[2] ..... H01H 85/04

[52] U.S. Cl. ..... 337/290; 337/293

[58] Field of Search ..... 337/290, 295, 293, 159, 337/160

[56] References Cited

U.S. PATENT DOCUMENTS

| | | | |
|---|---|---|---|
| 3,569,889 | 3/1971 | Amagasaki et al. | 337/159 |
| 3,747,041 | 7/1973 | Cameron | 337/290 X |
| 3,801,945 | 4/1974 | Howard | 337/290 |

*Primary Examiner*—George Harris

*Attorney, Agent, or Firm*—Erwin Salzer

[57] ABSTRACT

In fuses exceeding a certain voltage rating it is necessary to establish series multibreaks to interrupt small overload currents. An initial break is formed in the helically wound fusible elements near the center thereof where the temperature is highest. If the arc voltage along this initial break does not exceed the circuit voltage, even after a number of cycles of arcing, secondary or tertiary breaks must be formed in series to the initial break. This is achieved according to the present invention by providing one or more quarter-turns of reduced pitch where the spacing between contiguous groups of windings is reduced and a low temporary current flashover is allowed to occur which results in the formation of secondary and tertiary breaks.

3 Claims, 5 Drawing Figures

ELECTRIC FUSE CAPABLE OF INTERRUPTING SMALL CURRENTS

BACKGROUND OF THE INVENTION

The patent application of Frederick J. Kozacka, filed 03/07/77; Ser. No. 775,248 for ELECTRIC ALL PURPOSE FUSE suggests to limit the axial spacing between a plurality of parallel connected fusible elements to a critical distance at which an electric breakdown can occur, but a self-sustained high current discharge, or arc, cannot occur. The flashover damages the fusible elements, and results in break formation at the damaged point or points by additional $i^2.r$ losses at this point, or points, thus establishing the required series breaks.

This process has a number of limitations. While it is desirable to maximize the axial spacing between parallel connected turns of the helical windings of a fusible element, Kozacka calls for reduction of that spacing to a critical value. Another limitation of Kozacka resides in the fact that the point where the breakdown will occur is not pre-determined, but can occur randomly, at any point of the fusible elements. It may, for instance, occur near one of the terminal elements where an arc should not be initiated.

The primary object of this invention is to provide electric fuses which are not subject to the above limitations. Other objects will become apparent as this specification proceeds.

SUMMARY OF THE INVENTION

Fuses according to this invention include a tubular casing of electric insulating material, a pair of terminal elements closing the ends of said casing, and a granular quartz filler inside said casing. A group of fusible elements including a plurality of fusible elements conductively interconnects said pair of terminal elements. Said plurality of fusible elements is electrically connected in parallel, wound in substantially parallel helical paths around a common geometrical axis in rectangular turns and embedded in said quartz filler. The pitch of said turns remote from said pair of terminal elements is less than the pitch of said turns adjacent said pair of terminal elements whereby series multibreaks are produced at regions of said reduced pitch following initiation of an arc adjacent the centers of said group of fusible elements.

BRIEF DESCRIPTION OF THE DRAWINGS

FIG. 5 is a planar winding diagram of the fusible element obtained by cutting the winding along one of its support rods and spreading the winding into the plane of the paper on which FIG. 5 is drawn.

DESCRIPTION OF PREFERRED EMBODIMENT

Figure 1:
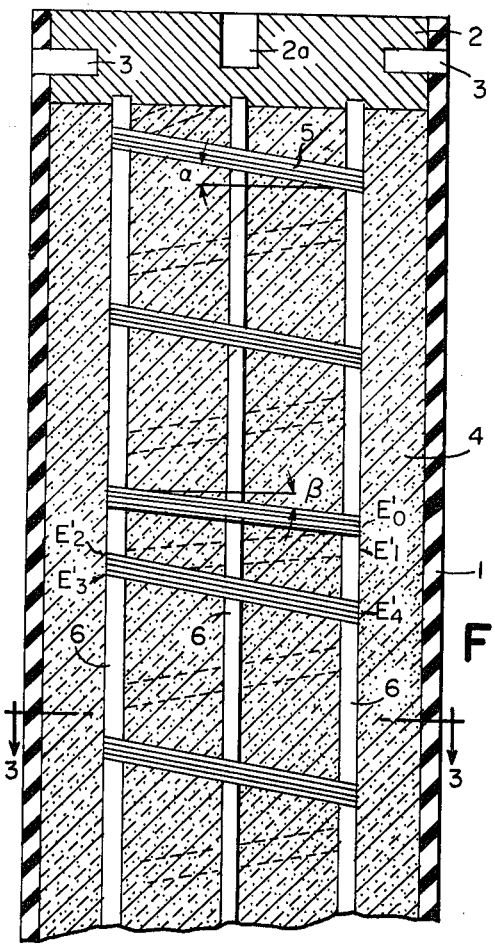
FIG. 1 is in part a front elevation and in part a longitudinal section of a fuse embodying the present invention.

Referring now to the drawing, numeral 1 has been applied to indicate a tubular casing of electric insulating material. Casing 1 is closed by a pair of terminal elements 2 which are in the shape of terminal plugs 2. Terminal plugs 2 are pinned to casing 1 by steel pins 3.

Casing 1 is filled with a granular arc-extinguishing filler 4 of quartz sand. A group 5 of fusible elements conductively interconnects terminal plugs 2. The constituent fusible elements of the group 5 are electrically connected in parallel and wound helically in quarter turns.

The fuse may be manufactured according to teaching in my U.S. Pat. No. 3,848,212, Nov. 12, 1974 for METHOD OF ASSEMBLING ELECTRIC HIGH-VOLTAGE FUSES AND SUBASSEMBLY THEREFOR, in which case the support rods 6 are removed after the fuse has been completed as more fully set forth in the above patent.

In the present drawing I have shown four rods 6 of insulating material which form a permanent part of the fuse structure. Rods 6 support the group 5 of fusible elements comprising four fusable elements. Rods 6 are secured with the ends thereof to terminal elements 2 and the fusible elements 5 are wound helically in rectangular quarter turns around rods 6. Some of the windings have a relatively large pitch $\alpha$, and some of the windings have a relatively small pitch $\beta$.

Referring to FIG. 1 windings 5 begin at A, go from there to B,C,D and $E_o$. The quarter turns such as from B to C, or from D to $E_o$, all have the same pitch $\alpha$. The pitch of the quarter turns of which the groups of fusible elements 5 is made up decreases in the quarter sections $E_o$–$E_1$
$E_1$–$E_2$
$E_2$–$E_3$ and
$E_3$–$E_4$.

A similar decrease in pitch occurs in the upper portions of the fuse between the quarter sections $E_o'$–$E_1'$
$E_1'$–$E_2'$
$E_2'$–$E_3'$
$E_3'$–$E_4'$.

The variations or reduction of the pitch provide points where the dielectric strength between turns of winding 5 is weakened and where a dielectric breakdown may occur. Such a breakdown will occur after an initial arc gap has been formed in the center region of fusible elements 5 (not shown in FIG. 5).

Figure 2:
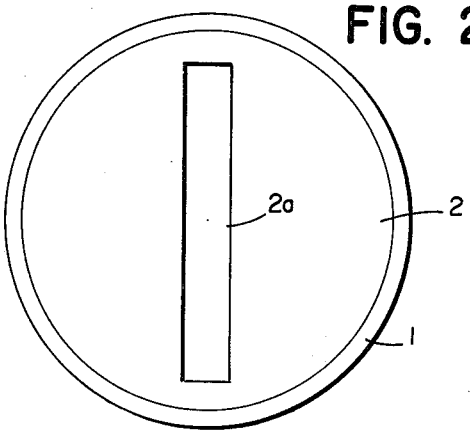
FIG. 2 is a top-plan view of the structure of FIG. 1.
Figure 3:
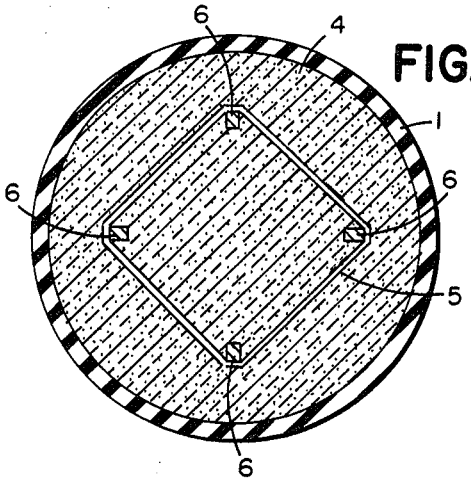
FIG. 3 is a section along 3—3 of FIG. 1.

FIGS. 1 and 2 show prismatic recesses 2*a* in terminal plugs 2 intended for the insertion of blade contacts (not shown).

It will be understood that the centers of the group 5 of fusible elements may or may not be provided with a so-called M-effect spot, i.e. an overlay of a low fusing point link-severing metal, e.g. tin.

Figure 5:
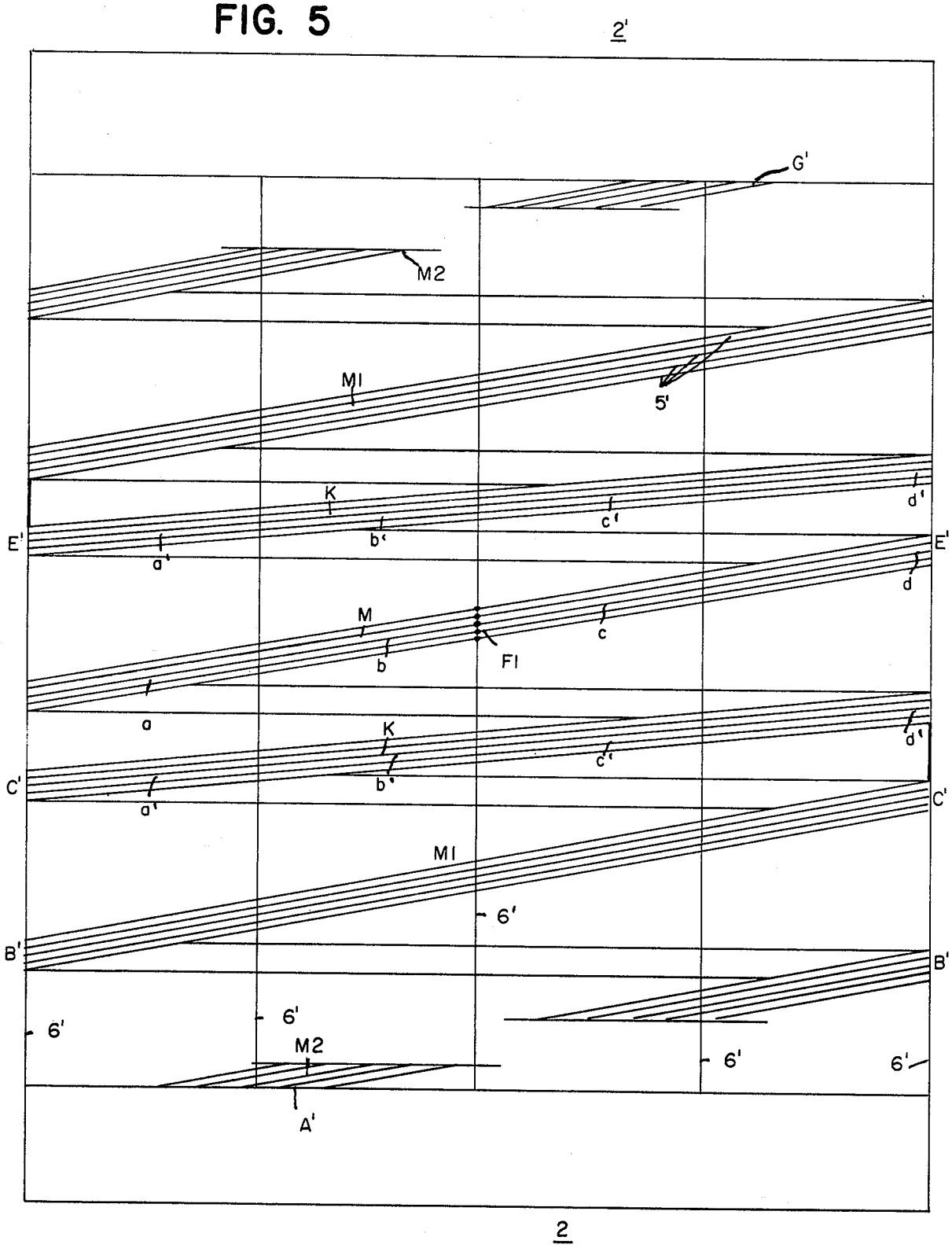

Referring now particularly to FIG. 5, thw winding begins at A′ and proceeds to B′ and C′. At C′ and E′ there is a drastic decrease of the pitch, each time for four consecutive quarter turns *a,b,c,d.* In other words, the spacing between quarter turns is smallest at C′ along rod 6′ and at E′ along rod 6′ where a sudden change of pitch occurs. The consecutive turns of the windings that begin at A′ on terminal 2 and end at G′ at terminal 2′ have been marked $M_2$,$M_1$,K,M,$M_1$, $M_2$. The pitch of turns K is reduced, that of intermediate turn M is normal. FI is the point where tin, or another low fusing point link-severing overlay, is located. Since the point FI is located in the center of the fuse, melting will be initiated at point FI of each of the fusible elements 5′. Thus an initial break is formed in each of them by the overlay FI. Since neither the fusible elements nor their overlays are absolutely identical, fusion of the overlays at FI and the fusible elements 5′ will not occur simultaneously, but in a rapid sequence. The melting of each fusible element will give rise to a voltage surge $-L\ (di/dt)$. If the gaps at C′ and E′ are slightly less than the breakdown voltage $-L\ (di/dt)$, the gaps will break down and form two additional breaks in the fusible elements, i.e. two breaks in each fusible element 5′ in addition to the breaks formed at FI. The discharges at C′ and E′ ought to be a momentary low current discharge, rather than a high current arc discharge.

Since this invention is predicated on the breakdown of a spark gap by $-L\ (di/dt)$, it is obvious that voltage must exceed the breakdown voltage of the spark gap. If this does not occur, a single break will be formed near the centers of fusible elements 5′ and the fuse is likely to fail on the one hour fusing current, or other small currents in that range.

Figure 4:
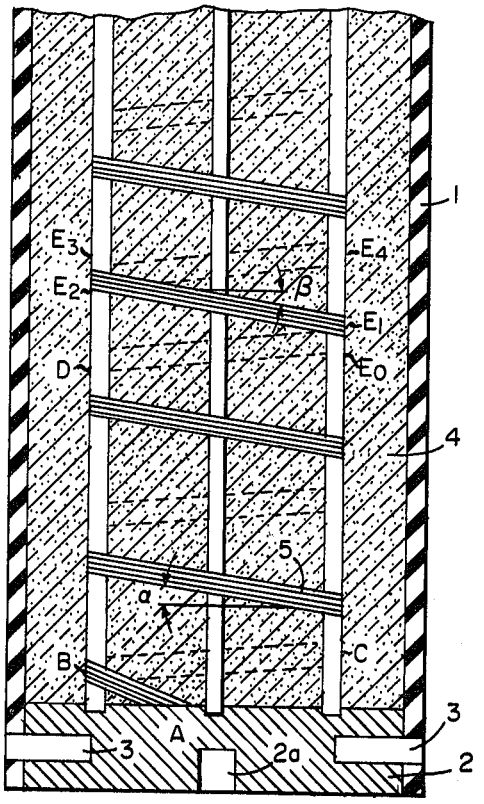
FIG. 4 is an elevational view on a larger scale of the fusible element of FIG. 1.
Figure 4:
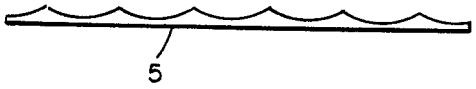

On the other hand, the voltage must be sufficiently small to avoid thermal emission and formation of an arc between turns, resulting in the formation of a fulgurite that short-circuits the turns. Among the various gas discharges that may cause a proper breakdown the surge breakdown in prominent. The points where the wire-like ribbon of which the fusible conductors 5 are formed (see FIG. 4) causes an electric field concentration. The sparking potential is a function of the product of pressure and gap length only. This fact plus an approximate knowledge of the range of $-L\ (di/dt)$ that occurs allow a determination of the pitch of the low pitch turns required to achieve the desired effect.

I claim as my invention:

1. An electric fuse calling for series multibreaks for the interruption of small overload currents including (a) a tubular casing of electric insulating material;

(b) a pair of terminal elements closing the ends of said casing;

(c) a granular quartz filler inside said casing;

(d) a plurality of fusible elements conductively interconnecting said pair of terminal elements, said plurality of fusible elements being electrically connected in parallel, wound helically in rectangular turns around a common geometrical axis and embedded in said quartz filler; and (e) the pitch of said turns remote from said pair of terminal elements being less than the pitch of said turns adjacent said terminal elements whereby series multibreaks are produced at regions of said reduced pitch following initiation of an arc adjacent the centers of said group of fusible elements.

2. An electric fuse as specified in claim 1 wherein the pitch of said plurality of fusible elements is relatively large adjacent said pair of terminal elements and adjacent the center region of said plurality of fusible elements and wherein there are two regions of relatively small pitch between said regions of relatively large pitch.

3. An electric fuse calling for series multibreaks for the interruption of small overload currents including a tubular casing of electric insulating material, a pair of terminal plugs closing the ends of said casing, a pulverulent arc-quenching filler inside said casing, a plurality of fusible elements electrically connected in parallel, wound helically in parallel paths around a common geometrical axis and interconnecting conductively said pair of terminal plugs wherein the improvement comprises two regions of relatively reduced pitch each to opposite sides of the center regions of said plurality of fusible elements whereby breaks are produced temporarily at said regions of relatively reduced pitch following formation of an initial break at said center region of said plurality of elements.

* * * * *